US007971977B2

(12) United States Patent
Nakata et al.

(10) Patent No.: US 7,971,977 B2
(45) Date of Patent: Jul. 5, 2011

(54) RETENTION DEVICE FOR INK CARTRIDGE AND RECORDING APPARATUS HAVING THE SAME

(75) Inventors: Satoshi Nakata, Matsumoto (JP); Akihisa Wanibe, Matsumotoshi (JP)

(73) Assignee: Seiko Epson Corporation, Tokyo (JP)

( * ) Notice: Subject to any disclaimer, the term of this patent is extended or adjusted under 35 U.S.C. 154(b) by 972 days.

(21) Appl. No.: 11/710,171

(22) Filed: Feb. 22, 2007

(65) Prior Publication Data

US 2007/0273734 A1 Nov. 29, 2007

(30) Foreign Application Priority Data

Feb. 22, 2006 (JP) ..... P2006-045892

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS

| | | | | |
|---|---|---|---|---|
| 6,413,105 | B2 | 7/2002 | Noro et al. | |
| 6,460,984 | B1 * | 10/2002 | Matsumoto et al. | 347/86 |
| 6,851,795 | B2 | 2/2005 | Watanabe et al. | |
| 6,979,079 | B2 * | 12/2005 | Hashii et al. | 347/86 |
| 7,213,914 | B2 | 5/2007 | Anma et al. | |
| 7,237,881 | B2 | 7/2007 | Hayasaki et al. | |
| 7,278,721 | B2 | 10/2007 | Shimizu et al. | |
| 7,350,910 | B2 | 4/2008 | Amma et al. | |
| 2004/0210424 | A1 * | 10/2004 | Seino et al. | 702/189 |
| 2005/0219303 | A1 | 10/2005 | Matsumoto et al. | |
| 2007/0052774 | A1 | 3/2007 | Shimizu et al. | |
| 2007/0195141 | A1 | 8/2007 | Anma et al. | |
| 2008/0204529 | A1 | 8/2008 | Matsumoto et al. | |
| 2009/0128609 | A1 | 5/2009 | Matsumoto et al. | |

FOREIGN PATENT DOCUMENTS

| | | | |
|---|---|---|---|
| CN | 1636744 | A | 7/2005 |
| JP | 11-273788 | | 10/1999 |
| JP | 11-334945 | | 12/1999 |
| JP | 3076570 | U | 4/2001 |
| JP | 2001326022 | A | 11/2001 |
| JP | 2002307673 | A | 10/2002 |
| JP | 2003-80722 | | 3/2003 |
| JP | 2004-351936 | | 12/2004 |
| JP | 2005-22345 | | 1/2005 |
| JP | 2005-251540 | | 9/2005 |

* cited by examiner

*Primary Examiner* — Mark A Robinson
*Assistant Examiner* — Erin D Chiem
(74) *Attorney, Agent, or Firm* — Nutter McClennen & Fish LLP; John J. Penny, Jr.; Michael P. Visconti, III

(57) ABSTRACT

A retention device for an ink cartridge for engaging and retaining a locking lever when the ink cartridge is attached to a carriage such that a contact between conductive connection portions of a cartridge-side substrate of the ink cartridge and contact terminals of a connector is in a desired state, the retention device includes: a position regulation portion that is provided at a mounting place of the ink cartridge in the carriage, and that is brought into contact with a part of the locking lever and regulates an engagement position of the locking lever when the ink cartridge is attached to the carriage.

6 Claims, 11 Drawing Sheets

RETENTION DEVICE FOR INK CARTRIDGE AND RECORDING APPARATUS HAVING THE SAME

BACKGROUND

1. Technical Field

The present invention relates to a retention device for an ink cartridge for preventing a relative position of conductive connection portions of a carriage-side substrate of the ink cartridge and contact terminals of a connector from being shifted when the ink cartridge is attached to the carriage, and to a recording apparatus having the retention device.

2. Related Art

In Patent Document 1, there is disclosed an ink cartridge that has levers, guiding convex portions, and stopper convex portions. Specifically, levers, each having the side of an ink supply port as a rotation fulcrum, are formed at two surfaces facing each other, and guiding convex portions that come into contact with an ink cartridge holder and move the levers in an opening direction are formed. Further, stopper convex portions that rotate the levers to such a degree as to disengage pawls from the ink cartridge holder are formed.

Patent Document 1: JP-A-2003-80722

As shown in FIG. 12, in an ink cartridge 100 having a locking lever 101, when the ink cartridge is accurately set in a cartridge accommodating portion of a carriage, an engagement portion 103 of the locking lever 101 is engaged with an engagement convex portion 105 on the carriage side. Further, contact terminals 109 and 111 on both surfaces of the connector 107 accurately come into contact with a substrate 113 of the cartridge and a substrate 115 of an apparatus main body, respectively. However, this is only limited to a case where an arm portion 117 of the locking lever 101 has a linearly extended original shape. As shown in FIG. 12, when the arm portion 117 is bent due to any reasons, such as reasons for molding, even though the engagement portion 103 of the locking lever 101 is engaged with the engagement convex portion 105, an original position 119 of the cartridge-side substrate 113 to come into contact is located above the position of the contact terminal 109 of the connector 107. Accordingly, the contact terminal 109 of the connector 107 and the cartridge-side substrate 113 may not come into contact with each other.

SUMMARY

An advantage of some aspects of the invention is to provide a retention device for an ink cartridge that regulates an engagement position of the locking lever and thereby a connector and a cartridge-side substrate can accurately come into contact with each other. The advantage can be attained by at least one of the following aspects:

A first aspect of the invention provides a retention device for an ink cartridge, for engaging and retaining a locking lever when the ink cartridge is attached to a carriage such that a contact between conductive connection portions of a cartridge-side substrate of the ink cartridge and contact terminals of a connector is in a desired state, the retention device comprising: a position regulation portion that is provided at a mounting place of the ink cartridge in the carriage, and that is brought into contact with a part of the locking lever and regulates an engagement position of the locking lever when the ink cartridge is attached to the carriage.

According to this aspect, the position regulation portion is brought into contact with a part of the lock lever and regulates the engagement position. Accordingly, even when, in a state where the shape of the locking lever is bent, the ink cartridge is attached to the carriage, the position regulation portion provided in the carriage operates to press the bent portion of the locking lever and to correct the bending deformation. Therefore, the contact terminals of the connector and the conductive connection portions of the carriage-side substrate can come into contact with each other with the accurate positional relationship.

According to a second aspect of the invention, in the retention device for an ink cartridge according to the first aspect of the invention, the position regulation portion may be provided to extend from a housing of the connector by integral molding. With this configuration, since the position regulation portion is provided in the connector itself, a housing of the connector can be easily produced by integral molding.

According to a third aspect of the invention, in the retention device for an ink cartridge according to the second aspect of the invention, the position regulation portion may serve as a knob portion when the connector is mounted on a connector holder.

With this configuration, the position regulation portion serves as the knob portion when the connector is mounted on the connector holder. Accordingly, after a mounting work of the connector is finished, the position regulation portion can continue to perform an original function. Therefore, one constituent member can be efficiently used.

According to a fourth aspect of the invention, in the retention device for an ink cartridge according to the first aspect of the invention, the position regulation portion may be formed integrally with the carriage and provided at a corresponding position. With this configuration, since the position regulation portion is provided in the carriage itself, the carriage can be easily produced by integral molding.

According to a fifth aspect of the invention, in the retention device for an ink cartridge according to any one of the first to fourth aspects of the invention, the position regulation portion may press the locking lever at two or more places to correct the bending deformation. According to this aspect, the bending deformation of the locking lever can be further effectively corrected.

According to a sixth aspect of the invention, a recording apparatus includes a carriage, having mounted thereon a recording head. An ink cartridge is attached to the carriage. The carriage has the retention device for an ink cartridge according to any one of the first to fifth aspects of the invention. With this configuration, the recording apparatus can have the same advantages and effects as the first to fifth aspects of the invention.

The present disclosure relates to the subject matter contained in Japanese patent application No. JP 2006-045892 filed on Feb. 22, 2006, which is expressly incorporated herein by reference in its entirety.

BRIEF DESCRIPTION OF THE DRAWINGS

The invention will be described with reference to the accompanying drawings, wherein like numbers reference like elements.

FIG. 5A is a front view showing a state where contacts are attached and FIG. 5B is a front view showing a state where contacts are detached.

DESCRIPTION OF EXEMPLARY EMBODIMENTS

Figure 1:
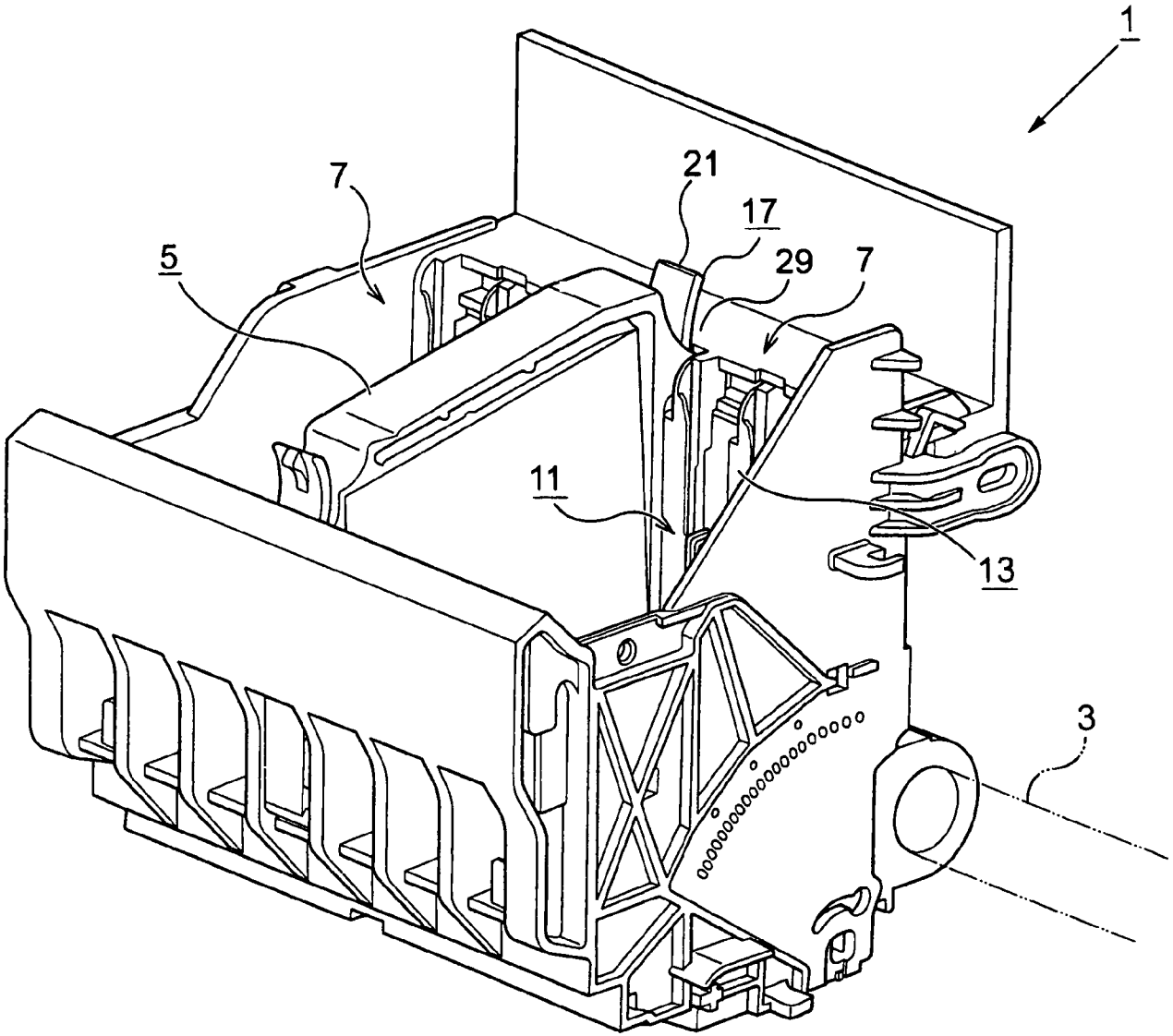
FIG. 1 is a perspective view of a carriage for a printer, to which a connector according to an embodiment of the invention is applied.
Figure 2:
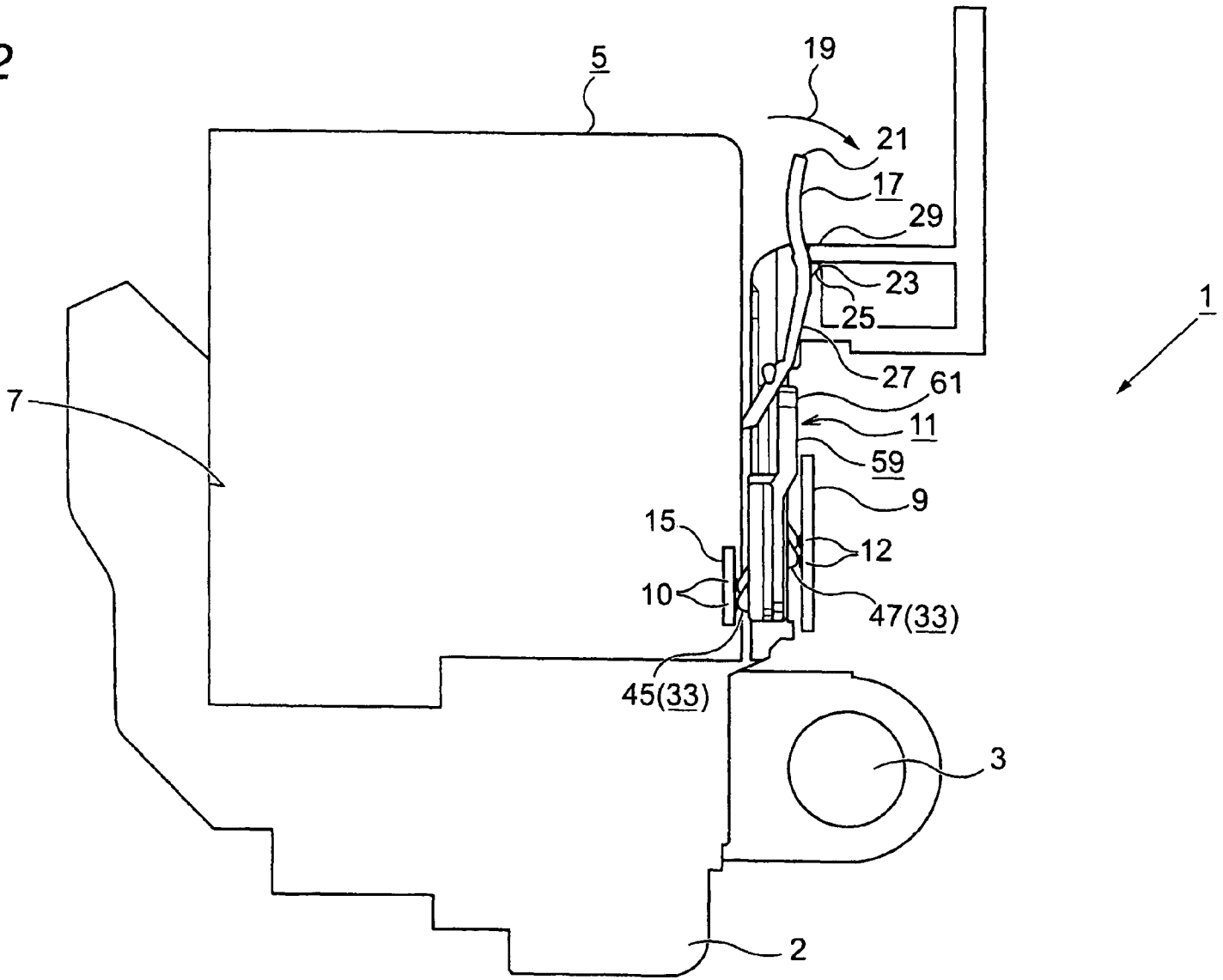
FIG. 2 is a side cross-sectional view showing a case where an ink cartridge is attached to a carriage.
Figure 3:
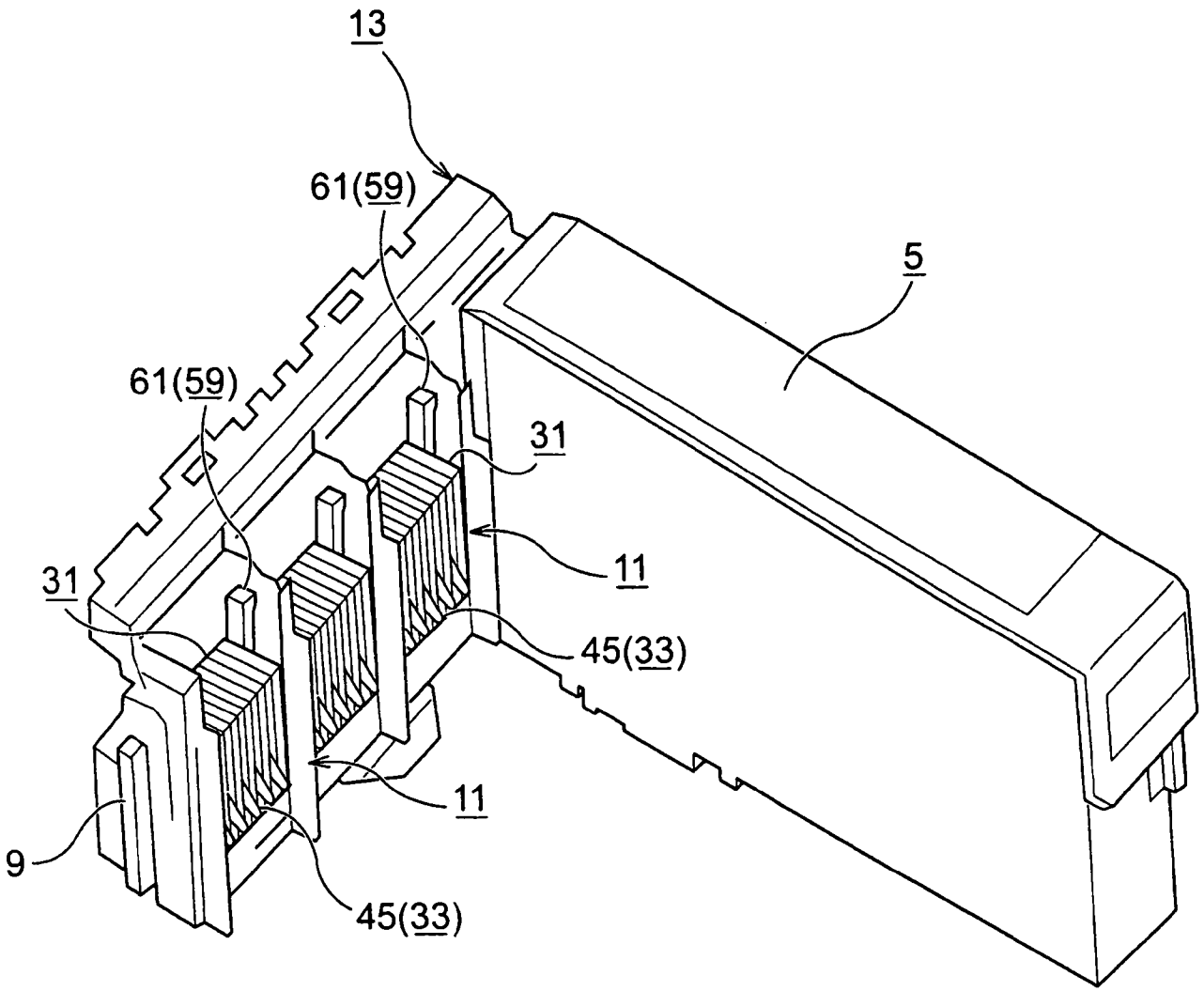
FIG. 3 is a perspective view showing the relationship between an ink cartridge and a connector.
Figure 4:
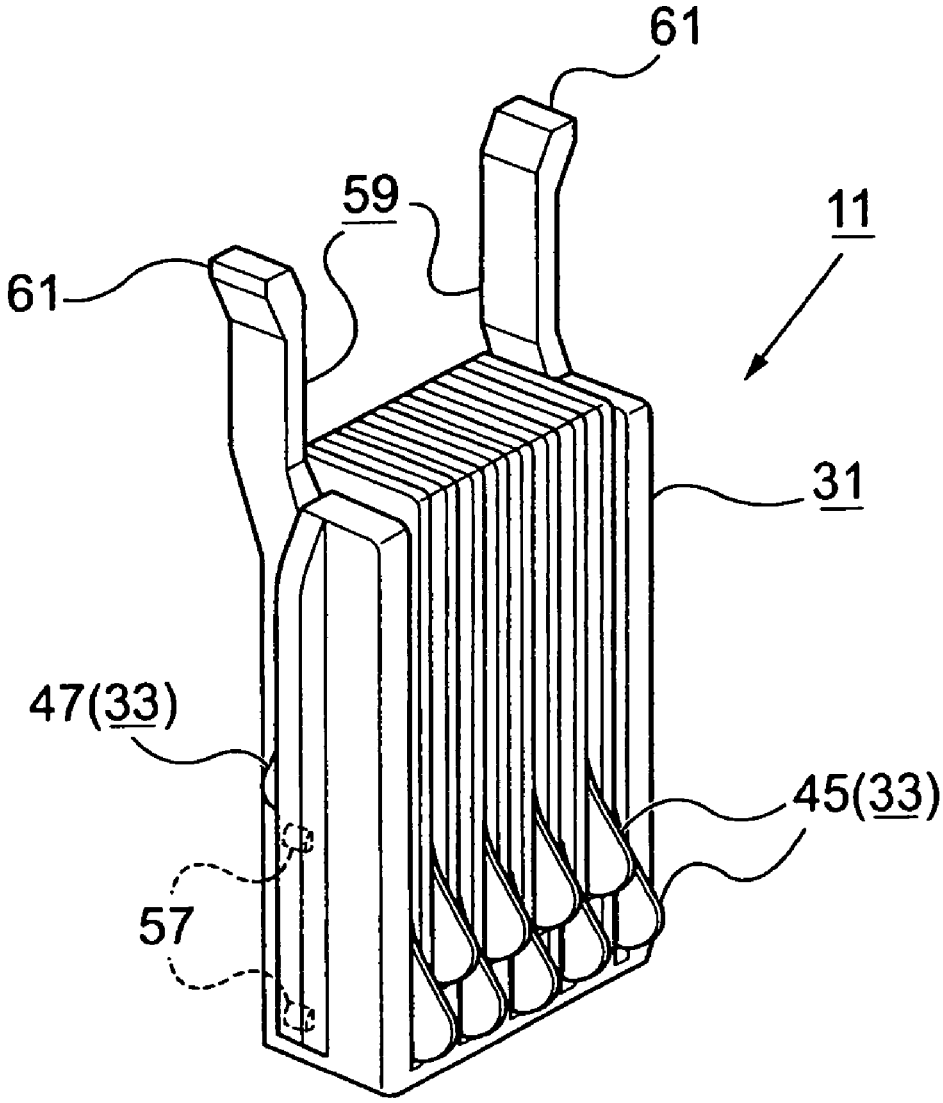
FIG. 4 is an overall perspective view of a connector.
Figure 5A:
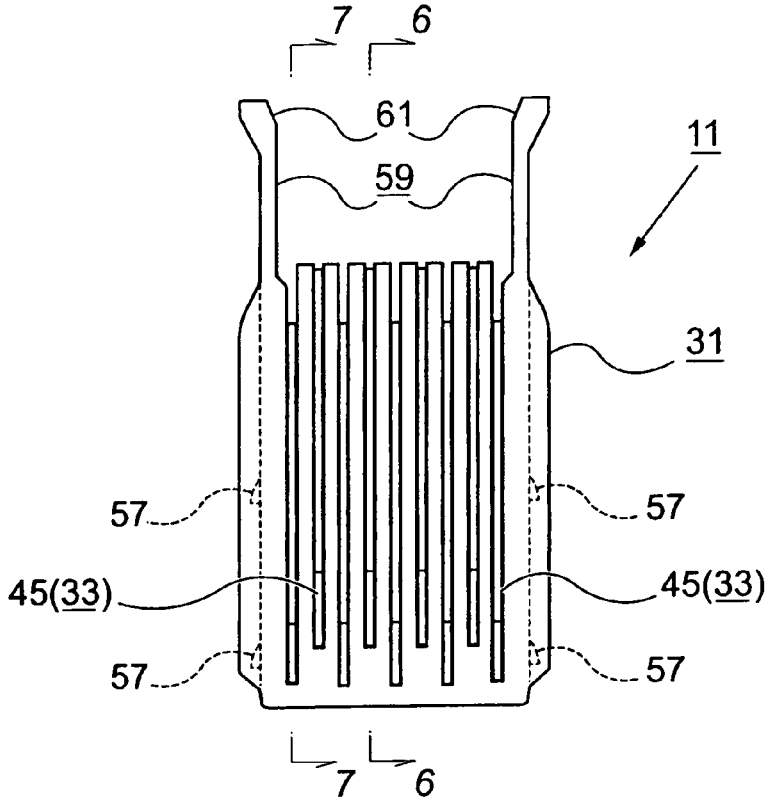
FIGS. 5A and 5B are front views of a connector on an ink cartridge side, and specifically.
Figure 5B:
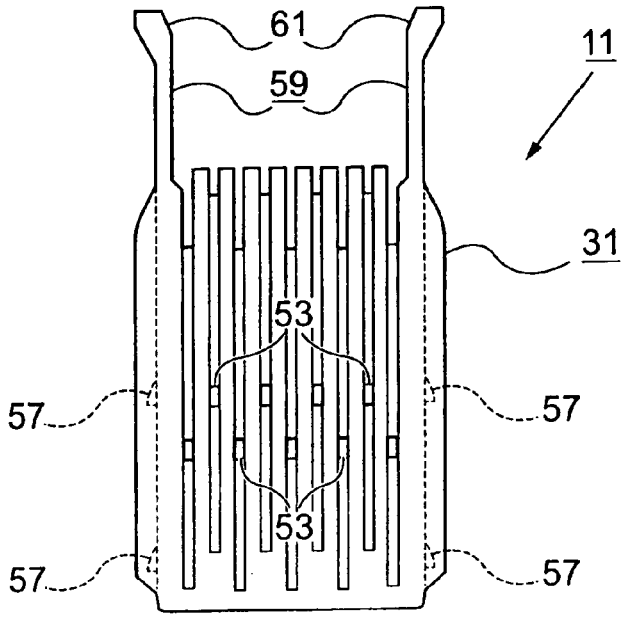
Figure 6:
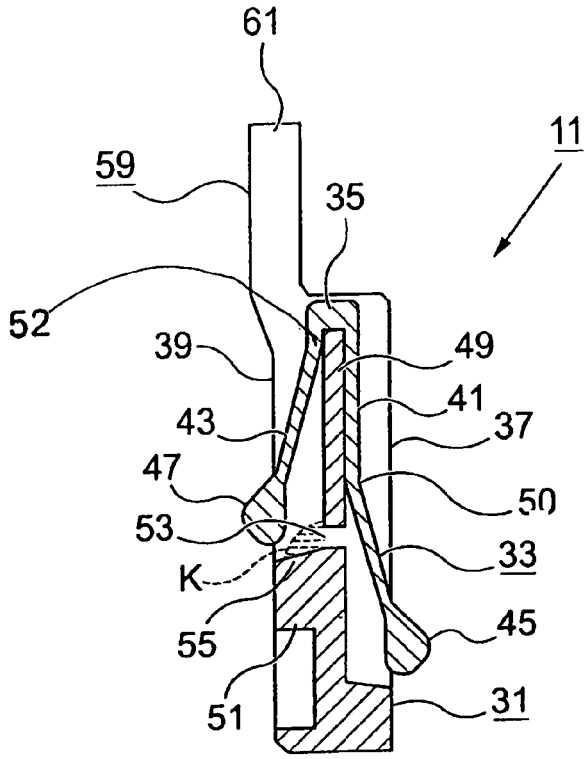
FIG. 6 is a side cross-sectional view of a connector taken along the line VI-VI of FIG. 5A.
Figure 7:
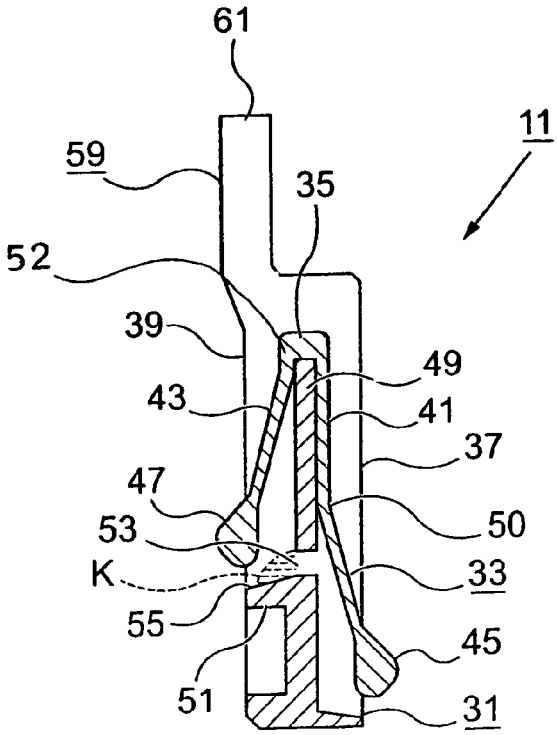
FIG. 7 is a side cross-sectional view of a connector taken along the line VII-VII of FIG. 5A.

An embodiment of the invention will now be described with reference to the drawings. FIG. 1 is a perspective view of a carriage for an ink jet printer, to which a retention device for an ink cartridge according to an embodiment of the invention is applied. FIG. 2 is a side cross-sectional view showing a case where an ink cartridge is attached to a carriage. FIG. 3 is a perspective view showing the relationship between an ink cartridge and a connector. FIG. 4 is an overall perspective view of a connector. FIGS. 5A and 5B are front views of a connector on an ink cartridge side. Specifically, FIG. 5A is a front view showing a state where contacts are attached, and FIG. 5B is a front view showing a state where contacts are detached. FIG. 6 is a side cross-sectional view of a connector taken along the line VI-VI of FIG. 5A. FIG. 7 is a side cross-sectional view of a connector taken along the line VII-VII of FIG. 5A.

Figure 8:
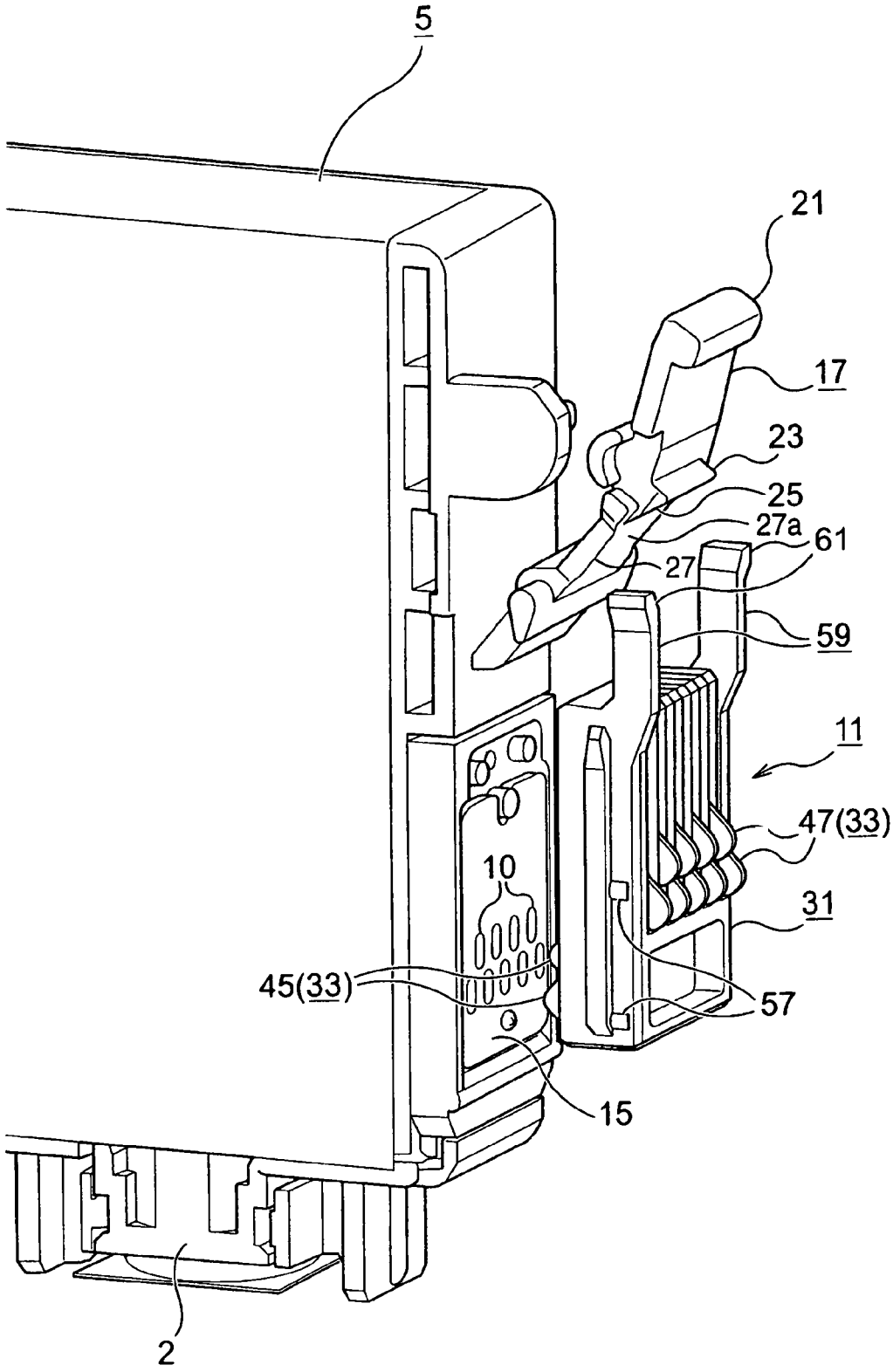
FIG. 8 is a perspective view showing the relationship between a connector and an ink cartridge.
Figure 9:
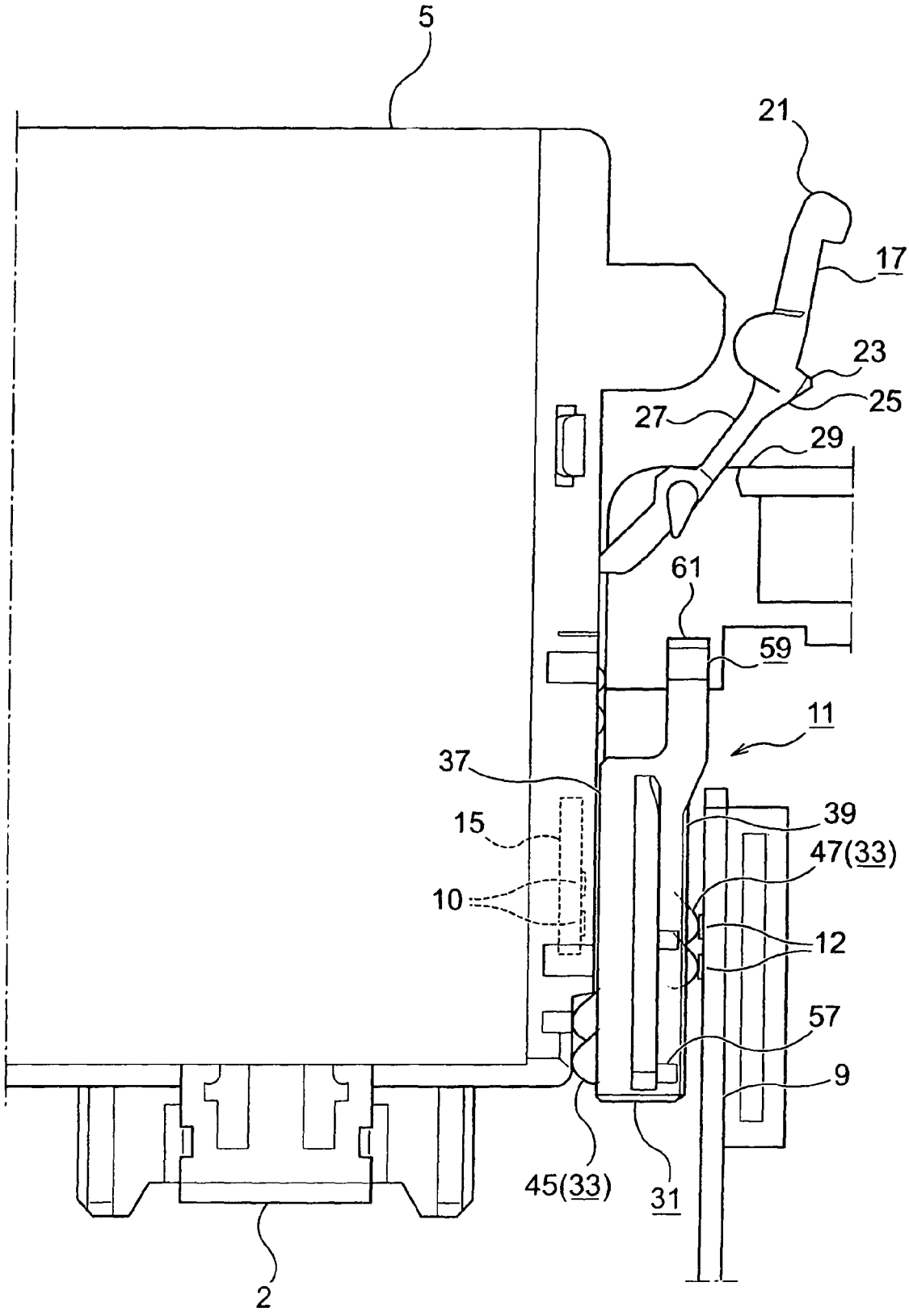
FIG. 9 is a side cross-sectional view showing a state immediately before an ink cartridge is completely mounted.
Figure 10:
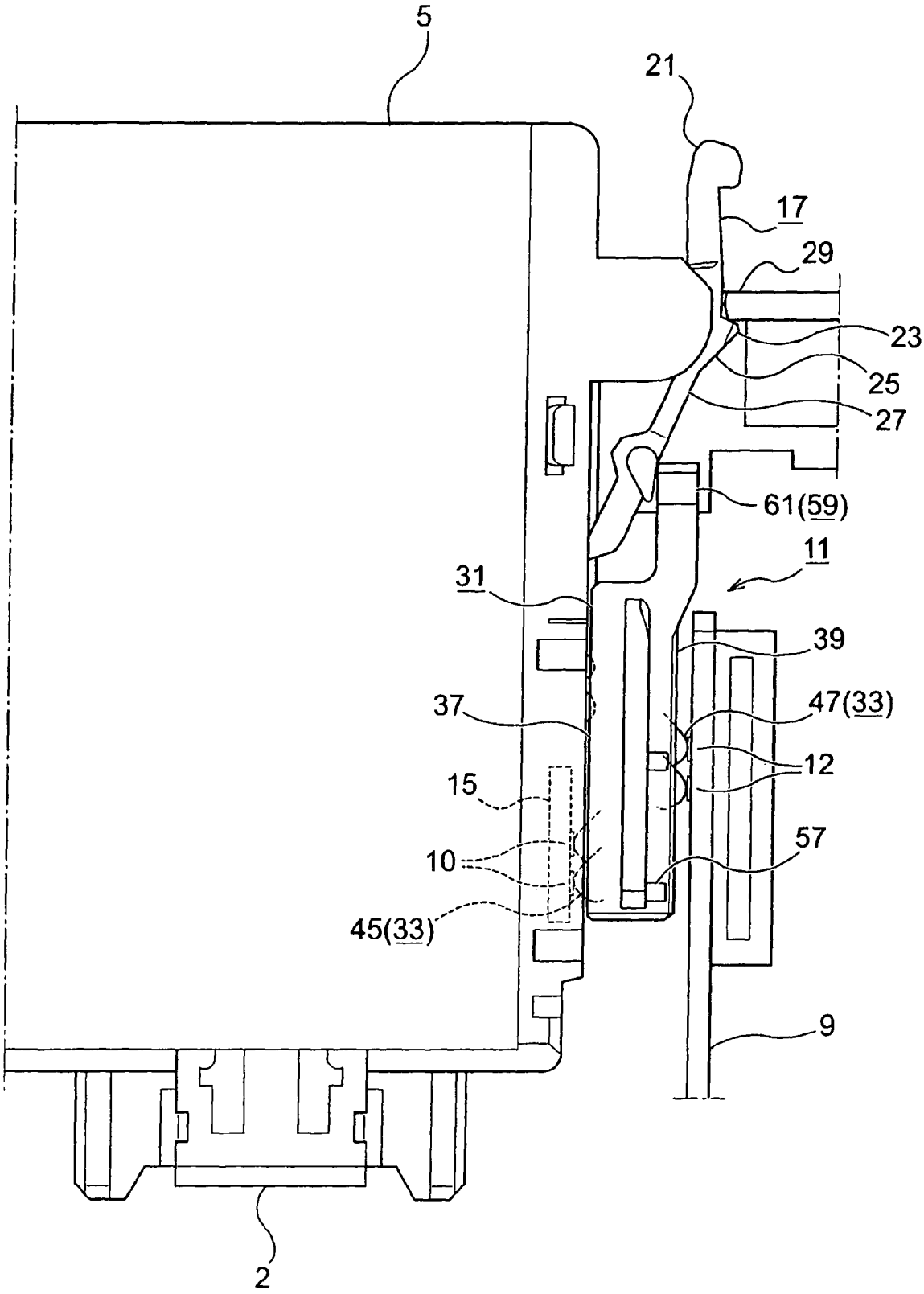
FIG. 10 is a side cross-sectional view showing a state where an ink cartridge is completely mounted.

FIG. 8 is a perspective view showing the relationship between a connector and an ink cartridge. FIG. 9 is a side cross-sectional view showing a state immediately before an ink cartridge is completely mounted. FIG. 10 is a side cross-sectional view showing a state where an ink cartridge is completely mounted.

In FIG. 1, reference numeral 1 denotes a carriage. A recording head 2 (see FIG. 2) is provided on a lower surface side of the carriage 1. The carriage 1 can reciprocate along a carriage guide shaft 3 in a direction perpendicular to a feed direction of a recording medium, thereby performing recording on the recording medium. In the carriage 1, a plurality of cartridge accommodating portions 7, each accommodating an ink cartridge 5, are formed. Further, an apparatus main body-side substrate 9 (see FIG. 2) is provided on a rear surface side of the carriage 1. Conductive connection portions 12 are formed in the apparatus main body-side substrate 9. Further, connectors 11 are provided to correspond to the cartridge accommodating portions 7 on a rear surface side of an inner surface of the carriage 1. The individual connectors 11 are held by a connector holder 13 (see FIG. 3), and the connector holder 13 is held in the carriage 1.

As shown in FIG. 8, in each ink cartridge 5, a cartridge-side substrate 15 is formed at a surface facing the connector 11, and a locking lever 17 is provided above the cartridge-side substrate 15 to fix the ink cartridge 5 to the carriage 1. Further, conductive connection portions 10 are formed in the cartridge-side substrate 15.

As shown in FIG. 2, when the ink cartridge 5 is attached to the carriage 1, the locking lever 17 is opened in a direction indicated by an arrow 19 by a reaction portion (not shown) on the carriage 1 side. An engagement portion 23 is formed immediately below a knob portion 21 at an uppermost end of the locking lever 17, and a lower surface of the engagement portion 23 is inclined to form an inclined surface 25. Further, an arm portion 27 that substantially linearly extends is formed below the engagement portion 23.

If the ink cartridge 5 is pushed into a cartridge accommodating portion 7, the inclined surface 25 is guided to an engagement convex portion 29 that is formed in the carriage 1, and the locking lever 17 temporarily suffers slight elastic deformation in a direction opposite to the arrow 19. After the engagement portion 23 passes through the engagement convex portion 29, the shape of the locking lever 17 returns in the direction of the arrow 19. Then, as shown in FIGS. 2 and 10, the engagement portion 23 is engaged with the lower side of the engagement convex portion 29, and thus the ink cartridge 5 is fixed.

Next, the configuration of each connector 11 will be described with reference to FIGS. 4 to 7. As shown in FIG. 10, a first surface 37 of the connector 11 comes into contact with the cartridge-side substrate 15, and a second surface 39 of the connector 11 comes into contact with the apparatus main body-side substrate 9 that is provided on the rear surface side of the carriage 1. Then, the carriage-side substrate 15 and the apparatus main body-side substrate 9 are electrically connected to each other. As shown in FIGS. 4, 5A, and 5B, in the connector 11, nine metal contacts 33 are arranged in parallel in a housing 31 formed of a known material. As shown in FIGS. 4, 5A, 6, and 7, the nine metal contacts 33 are arranged in two rows so as to be alternatively located at the same positions in side view. Adjacent contacts 33 are arranged to be shifted in a longitudinal direction of the housing 31. To a whole, the contacts 33 are arranged in a zigzag shape.

As shown in FIGS. 6 and 7, the contacts 33 have the same shape. Each of the contacts 33 mainly includes a first contact arm 41 that extends toward the first surface 37 with a base end 35 as a start point, and a second contact arm 43 that extends toward the second surface 39 and is shorter than the first contact arm 41. Substantially semicircular contact terminals 45 and 47 are formed at front ends of the contact arms 41 and 43. The second contact arm 43 is formed to be shorter than the first contact arm 41. The base ends 35 are forced against a thin plate portion 49 formed in the housing 31, and then the contacts 33 are supported by the housing 31.

The first contact arm 41 extends close to the plate portion 49 on the way and is bent outward from a bent portion 50 as a separation start portion from the plate portion 49. Further, the contact terminal 45 protrudes from the first surface 37 of the housing 31, and the first contact arm 41 is bent inward in a plate spring shape when a load is applied to the contact terminals 45. In the second contact arm 43, a bent portion 52 as a separation start portion is located close to the base end 35. The second contact arm 43 is opened outward from the bent portion 52. The contact terminal 47 protrudes from the second surface 39 of the housing 31. Accordingly, when a load is applied to the contact terminal 47, the second contact arm 43 is bent inward in a plate spring shape.

In the housing 31, a thick base portion 51 that is located on the contact terminal 45 or 47 side is formed, in addition to the thin plate portion 49. As such, if the thick base portion 51 is formed in the housing 31, hardness of the entire housing 31 increases. Accordingly, a decrease in contact load due to the deformation of the housing 31 and a defective contact of the contact terminal based on the decrease in contact load can be prevented.

As shown in FIGS. 5B, 6, and 7, a small through hole 53 that passes through the housing 31 from the first surface 37 toward the second surface 39 is formed in the vicinity of the contact terminal 45 of the bent portion 50 of the first contact arm 41. The bent portion 52 as the separation start position from the plate portion 49 of the second contact arm 43 that is located on the second surface 39 side of the small through hole 53 is spaced apart from the small through hole 53 farther than the bent portion 50 of the first contact arm 41.

If the small through hole 53 is provided, the following effects are obtained. That is, if ink is stuck to the first surface 37 of the connector 11 from the ink cartridge 5, and ink remains in the vicinity of the bent portion 50 as the separation start position from the plate portion 49 of the first contact arm 41, the contact 33 may corrode at that portion. The small through hole 53 that is provided in the vicinity of the bent portion 50 avoids the above-described phenomenon, such that ink remaining in the vicinity of the bent portion 50 is actively discharged to the second surface 39 through the small through hole 53. Accordingly, stuck ink does not remain in the vicinity of the bent portion 50 of the first contact arm 41, and thus the contact 33 can be prevented from corroding at that portion. Further, the contact load of the first contact arm 41 can be stably maintained in a predetermined range with no change.

On the second surface 39 side where stuck ink is discharged, the bent portion 52 as the separation start position from the plate portion 49 of the second contact arm 43 is located farther from the small through hole 53 than the bent portion 50 of the first contact arm 41. Accordingly, there is little possibility that ink enters a gap defined in the bent portion 52 of the second contact arm 43. Ink discharged to the second surface 39 resides in a region spaced apart from the second contact arm 43 of the housing 31, is temporally dried, and reaches an impeccable state.

As described above, since the contacts 33 are arranged in the zigzag shape to a whole, adjacent bent portions 50 of the first contact arms 41 are also located in a zigzag shape. Similarly, the small through holes 53 are arranged in a zigzag shape to correspond to the positions of the bent portions 50 of the first contact arms 41. Accordingly, hardness of the housing 31 can be prevented from being degraded due the small through holes 53. Simultaneously, when ink is discharged to the second surface 39 through the small through holes 53, the discharge positions are also distributed in a zigzag shape, and ink is easily dried.

In this embodiment, a tapered portion 55 that is inclined in a direction distant from the contact terminal 47 of the second contact arm 43 is formed at a portion of the base portion 51 facing the contact terminal 47 of the second contact arm 43. In addition, the tapered portion 55 is formed to be connected to the small through hole 53. Accordingly, as shown in FIGS. 6 and 7, ink K that is guided to the second surface 39 through the small through hole 53 is guided in a direction distant from the second contact arm 43 and the contact terminal 47 thereof along the surface of the tapered portion 55. Therefore, there is little possibility that ink K comes into contact with the second contact arm 43 and the contact terminal 47 thereof.

Moreover, shift preventing protrusions 57 are formed on both surfaces of the housing 31 at positions substantially corresponding to the contact terminals 45 and 47 such that the position of the connector 11 is not shifted in a direction parallel to the surface of the apparatus main body-side substrate 9. With the protrusions 57, the position shift of the housing 31 is prevented.

Next, a structure that reliably brings the contact terminals 45 and 47 into contact with the conductive connection portions 10 of the cartridge-side substrate 15 and the conductive connection portions 12 of the apparatus main body-side substrate 9 will be described. When the ink cartridge 5 is accurately set in the cartridge accommodating portion 7 of the carriage 1, as shown in FIG. 10, the engagement portion 23 of the locking lever 17 is engaged with the engagement convex portion 29, and the contact terminals 45 and 47 accurately come into contact with the conductive connection portions 10 of the cartridge-side substrate 15 and the conductive connection portions 9 of the apparatus main body-side substrate 12. However, this is only limited to a case where the arm portion 27 of the locking lever 17 has a linearly extended original shape. When the arm portion 27 is bent due to any reasons, such as reasons for molding, even though the engagement portion 23 of the locking lever 17 is engaged with the engagement convex portion 29, the conductive connection portions 10 of the cartridge-side substrate 15 are located above the original positions. Accordingly, the conductive portions 10 of the cartridge-side substrate 15 and the contact terminals 45 of the connector 11 may not accurately come into contact with each other.

Accordingly, as shown in FIG. 10, a retention device 59 that is formed integrally with the housing 31 is provided to extend upward from both sides in a widthwise direction of the housing 31 of the connector 11. When the ink cartridge 5 is accurately attached to the cartridge accommodating portion 7, the position regulation portion of the retention device 59 is brought into contact with the arm portion 27 and regulates an engagement position of the lock lever 17. That is, by regulating the engagement position of the lock lever, when the engagement portion 23 of the lock lever 17 engages with the engagement convex portion 29, the conductive portions 10 of the cartridge-side substrate 15 is correctly in contact with the contact terminals 45 of the connector 11. Specifically, when the arm portion 27 is deformed to be bent in a direction apart from the cartridge main body, the position regulation portion 61 formed at an upper end of the retention device 59 to press a contact face 27*a* of the bent arm portion 27 in the direction of the cartridge main body and to correct the bending deformation. When the ink cartridge 5 is accurately attached to the cartridge accommodating portion 7, the length of the retention device 59 is set to such a length that the position regulation portion 61 of the retention device 59 is brought into contact with the arm portion 27 and, when the ink cartridge 5 is forced to a predetermined depth position, the contact terminals 45 can exactly come into contact with the conductive connection portions 10 of the cartridge-side substrate 15.

In this embodiment, the position regulation portion 61 is configured to serve as a knob portion when the connectors 11 are mounted on the connector holder 13. Accordingly, after the mounting work of the connectors is finished, the function as the knob portion ends, and then the function as the position regulation portion 61 can be continued. Therefore, one constituent member can be continuously and efficiently used.

Other Embodiments

Figure 11:
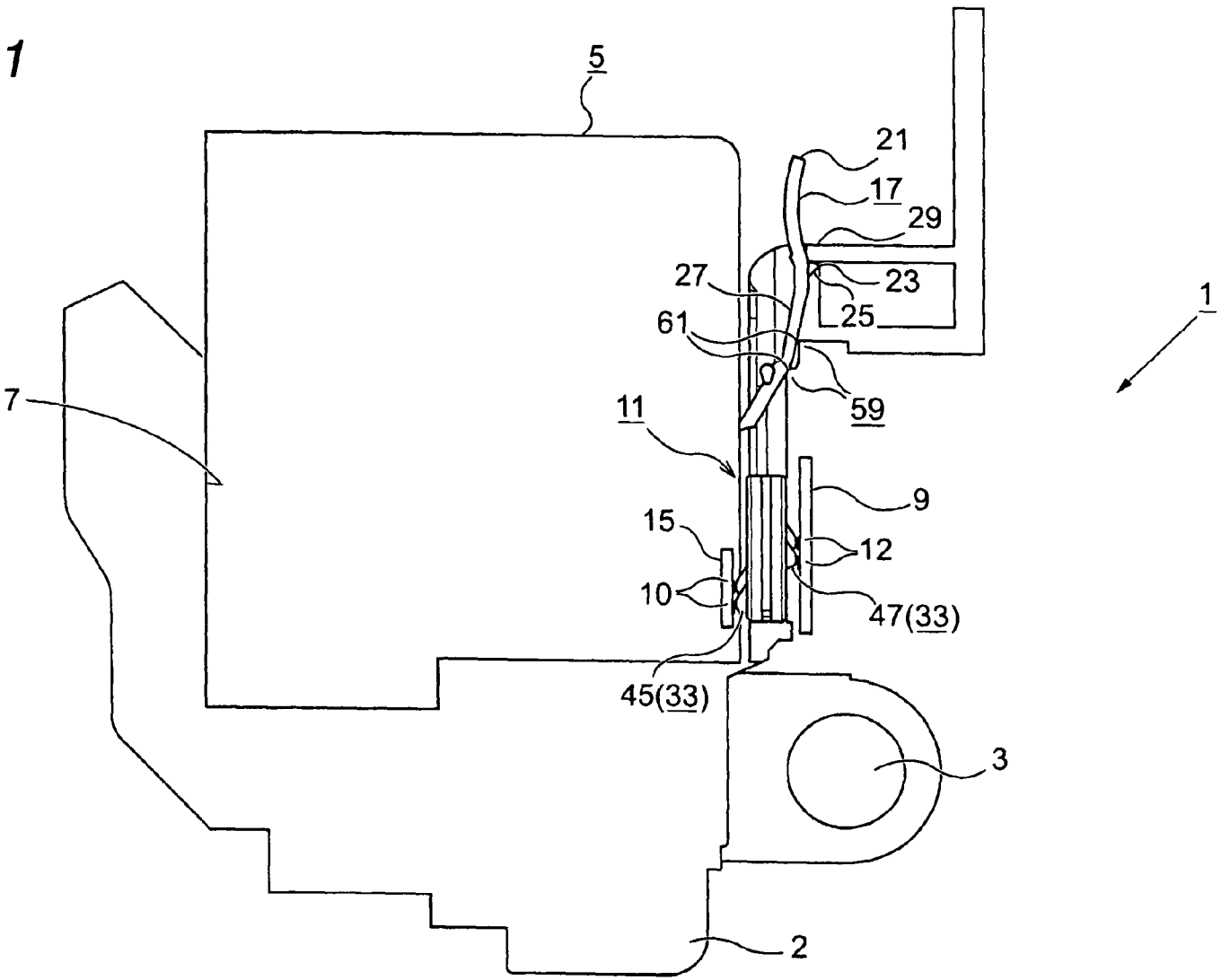
FIG. 11 is a side cross-sectional view showing a retention device according to another embodiment of the invention.
Figure 12:
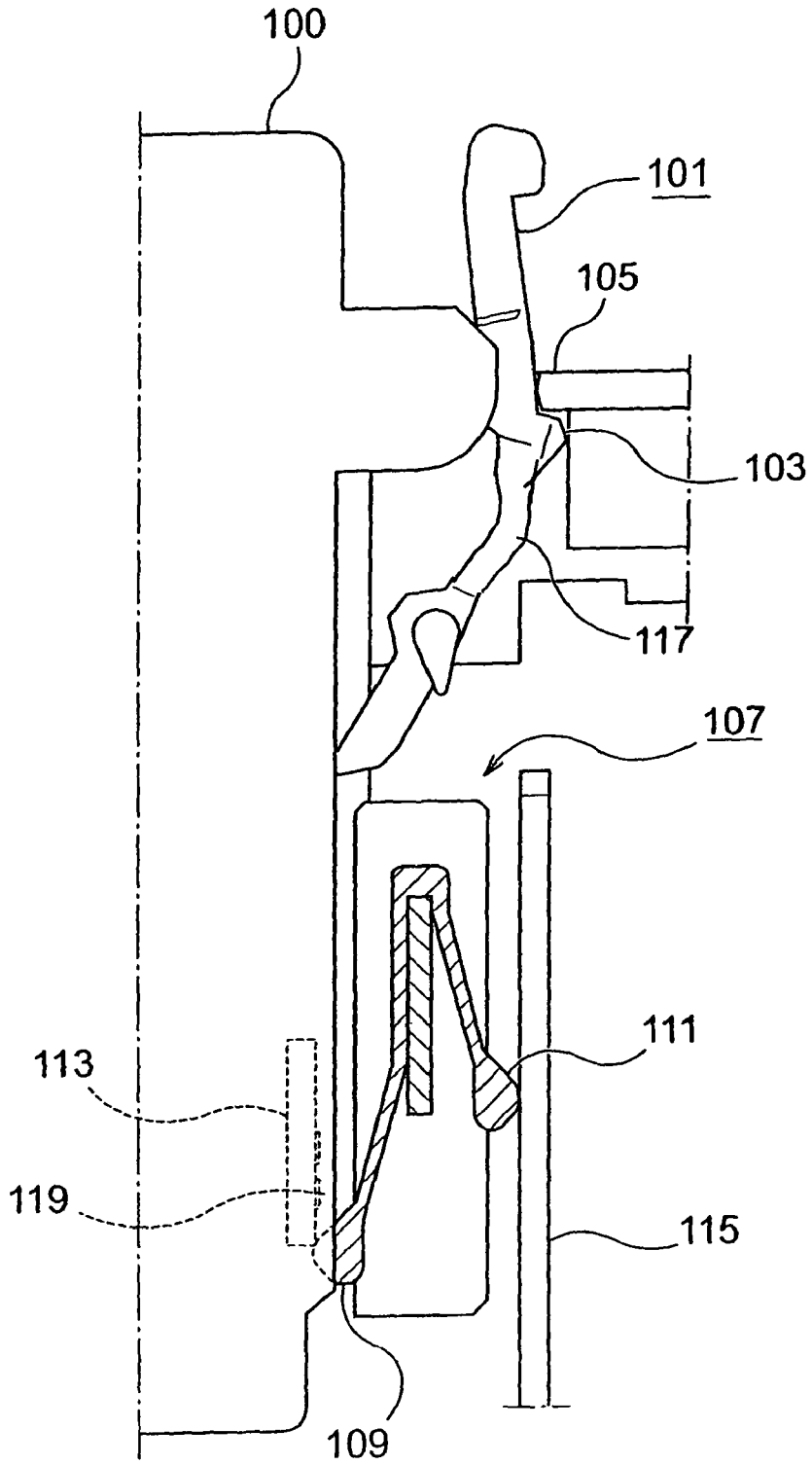
FIG. 12 is a side cross-sectional view showing a state where a locking lever is mounted as deformed.

FIG. 11 shows a modification of the retention device 59. In this example, the retention device 59 is formed in the carriage 1 to be integrated therewith, not in the connector 11. That is, as shown in FIG. 11, for example, position regulation portions 61, each having an angular front end, are formed at two places in the carriage 1. Further, as shown in FIG. 11, the two position regulation portions 61 come into contact with the arm portion 27 of the locking lever 17 at two different places, thereby correcting the bending deformation of the arm portion 27.

Of course, when the retention device 59 is formed in the carriage 1, the retention device 59 may be formed at one place or may be formed at three or more places.

What is claimed is:

1. A carriage comprising:

an accommodating portion configured to accommodate an ink cartridge, the ink cartridge including a conductive connection portion and a locking lever, the locking lever including an engaging portion and an arm portion, wherein the conductive connection portion and the locking lever are provided on a surface of the ink cartridge;

an engagement convex portion configured to be engaged with the engaging portion when the ink cartridge is accommodated in the accommodating portion; and a connector which includes a housing having a contact terminal and being integrally formed with a position regulation portion, the connector being configured to face the surface of the ink cartridge and the contact terminal being configured to be in contact with the conductive connection portion when the ink cartridge is accommodated in the accommodating portion, the position regulation portion being configured to press against the arm portion when the ink cartridge is accommodated in the accommodating portion and the engagement convex portion is engaged with the engaging portion;

wherein the position regulation portion serves as a knob portion when the connector is mounted on a connector holder.

2. The carriage according to claim 1, wherein the position regulation portion is integrally molded with the housing and extends therefrom.

3. The carriage according to claim 1, wherein the position regulation portion presses against the arm portion at two or more places to regulate an engagement position of the locking lever.

4. The carriage according to claim 1, wherein the position regulation portion is arranged to press against an abutment surface of the arm portion, the abutment surface facing a side of the connector.

5. The carriage according to claim 4, wherein the position regulation portion presses the abutment surface toward a main body of the ink cartridge.

6. A recording apparatus incorporating the carriage according to claim 1 to which the ink cartridge is attached, the recording apparatus comprising:

a recording head mounted on the cartridge.

* * * * *